US008797227B2

(12) United States Patent
Owens

(10) Patent No.: US 8,797,227 B2
(45) Date of Patent: Aug. 5, 2014

(54) SLOT HALO ANTENNA WITH TUNING STUBS

(75) Inventor: Roger Owens, Huntsville, AL (US)

(73) Assignee: Skywave Antennas, Inc., Huntsville, AL (US)

( * ) Notice: Subject to any disclaimer, the term of this patent is extended or adjusted under 35 U.S.C. 154(b) by 141 days.

(21) Appl. No.: 13/349,120

(22) Filed: Jan. 12, 2012

(65) Prior Publication Data

US 2012/0256808 A1 Oct. 11, 2012

Related U.S. Application Data

(63) Continuation-in-part of application No. 12/619,506, filed on Nov. 16, 2009, now Pat. No. 8,542,153.

(51) Int. Cl.
*H01Q 1/42* (2006.01)
*H01Q 1/38* (2006.01)

(52) U.S. Cl.
USPC ..... 343/872; 343/700 MS

(58) Field of Classification Search
CPC ..... H01Q 1/42; H01Q 1/422; H01Q 1/38
USPC ..... 343/872, 702, 700 MS, 767–771, 873
See application file for complete search history.

(56) References Cited

U.S. PATENT DOCUMENTS 4,218,685 A 8/1980 Ellis, Jr.
4,315,266 A * 2/1982 Frosch et al. ..... 343/895
4,692,769 A 9/1987 Gegan
4,924,236 A 5/1990 Schuss et al.
5,191,351 A * 3/1993 Hofer et al. ..... 343/895
5,202,697 A 4/1993 Bonebright et al.
5,406,292 A 4/1995 Schnetzer et al.
5,539,420 A 7/1996 Dusseux et al.
5,621,419 A * 4/1997 Meek et al. ..... 343/770
6,292,152 B1 * 9/2001 Cosenza et al. ..... 343/745
6,300,907 B1 10/2001 Lazar et al.
6,424,316 B1 7/2002 Leisten
6,606,070 B2 8/2003 Olson et al.
6,717,549 B2 4/2004 Rawnick et al.
6,914,574 B2 7/2005 Fourdeux et al.
7,046,209 B1 * 5/2006 McCarville et al. ..... 343/797
7,551,145 B2 * 6/2009 Tavassoli Hozouri ..... 343/770
7,610,065 B2 10/2009 Vallapureddy et al.
7,948,443 B2 * 5/2011 Bullock et al. ..... 343/789

(Continued)

OTHER PUBLICATIONS

International Search Report and Written Opinion issued Mar. 8, 2013 in corresponding International Application No. PCT/US2012/072136 filed Dec. 28, 2012.

(Continued)

*Primary Examiner* — Huedung Mancuso
(74) *Attorney, Agent, or Firm* — Angela Holt; Bradley Arant Boult Cummings LLP

(57) ABSTRACT

An antenna of the present disclosure has a housing having a shallow cavity in the housing and a flat, disk-shaped radiating element disposed in the shallow cavity, the radiating element having an arc shape slot. In addition, the antenna has a substantially circular parasitic element disposed in the shallow cavity on the bottom of the housing. The antenna operates as a half-wave antenna at a frequency range of 450 MHz to 470 MHz and as a full-wave antenna at a frequency range of 902 MHz to 928 MHz.

22 Claims, 12 Drawing Sheets

(56) References Cited

U.S. PATENT DOCUMENTS

| | | | | |
|---|---|---|---|---|
| 8,542,153 | B2 * | 9/2013 | Owens | 343/702 |
| 2005/0035914 | A1 | 2/2005 | Winter | |
| 2010/0097275 | A1 | 4/2010 | Parsche et al. | |
| 2011/0115678 | A1 | 5/2011 | Owens | |

OTHER PUBLICATIONS

International Search Report and Written Opinion issued Jan. 18, 2011 in related International Application No. PCT/US2010/056831 filed Nov. 16, 2010.

* cited by examiner

SLOT HALO ANTENNA WITH TUNING STUBS

CROSS REFERENCE TO RELATED APPLICATIONS

This application is a continuation-in-part of U.S. Non-Provisional Patent Application Ser. No. 12/619,506 now U.S. Pat. No. 8,542,153, entitled "SLOT HALO ANTENNA DEVICE" and filed on Nov. 16, 2009.

FIELD OF THE INVENTION

The present disclosure generally relates to the field of antennas. More particularly, the present disclosure relates to antennas having a low-profile installation that radiate radio-frequency (RF) energy.

BACKGROUND & SUMMARY

An antenna is a device that transmits and/or receives electromagnetic waves. In this regard, the antenna converts electromagnetic waves into an electrical current and converts electrical current into electromagnetic waves. Typically, the antenna is an arrangement of one or more conductors, which are oftentimes referred to as elements. To transmit a signal, a voltage is applied to terminals of the antenna, which induces an alternating current (AC) in the elements of the antenna, and the elements radiate an electromagnetic wave indicative of the induced AC. To receive a signal, an electromagnetic wave from a source induces an AC in the elements, which can be measured at the terminals of the antenna.

The design of the antennas typically dictates the direction in which the antenna transmits signals in a particular direction. Notably, an antenna may transmit signals horizontally (parallel to the ground) or vertically. One common antenna is a vertical rod. A vertical rod antenna receives and transmits in a vertical direction. One limitation of the vertical rod antenna is that it does not transmit or receive in the direction in which the rod points, i.e., it does not transmit or receive vertically.

There are two types of antenna directional patterns: omni-directional and directional. An omni-directional antenna radiates equally in all directions. An example of an omni-directional antenna is the vertical rod antenna. A directional antenna radiates in one direction more than another.

Antennas are oftentimes used in radio telemetry systems for system control and data acquisition (SCADA) applications, where a vertical rod antenna may not be desirable. In this regard, antennas may be used in traffic control security, irrigation systems, gas, electric, water and power line communications. In such exemplary systems, the antenna may need to be mounted in a location that would not be appropriate for normal length vertical rod antennas. Indeed an antenna used in such systems may need to be mounted in a position such that the vertical rod antenna would physically interfere with other equipment being used in the system, or could easily be vandalized, which could render the system inoperable.

An antenna of the present disclosure has a very low profile, making it desirable for certain installation needs. The antenna has a housing having a shallow cavity in a top of the housing and a shallow cavity in a bottom of the housing. The antenna further has a substantially circular radiating element disposed in the shallow cavity on the top of the housing, the radiating element having an arc shape slot. Tuning stubs extend from the antenna in a same plane as the radiating element to tune the high- and low-frequency ends of the spectrum. In addition, the antenna has a substantially circular parasitic element spaced apart from and parallel to the radiating element.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

The present disclosure generally pertains to a low-profile horizontally mounted antenna for mounting to plastics, metals and concrete without requiring the retuning of the antenna. In particular, the low-profile antenna of the present disclosure is a half-wave or a full-wave omni-directional antenna that uniformly radiates a predominantly vertically polarized antenna signal that has some horizontal radiation.

Figure 1:
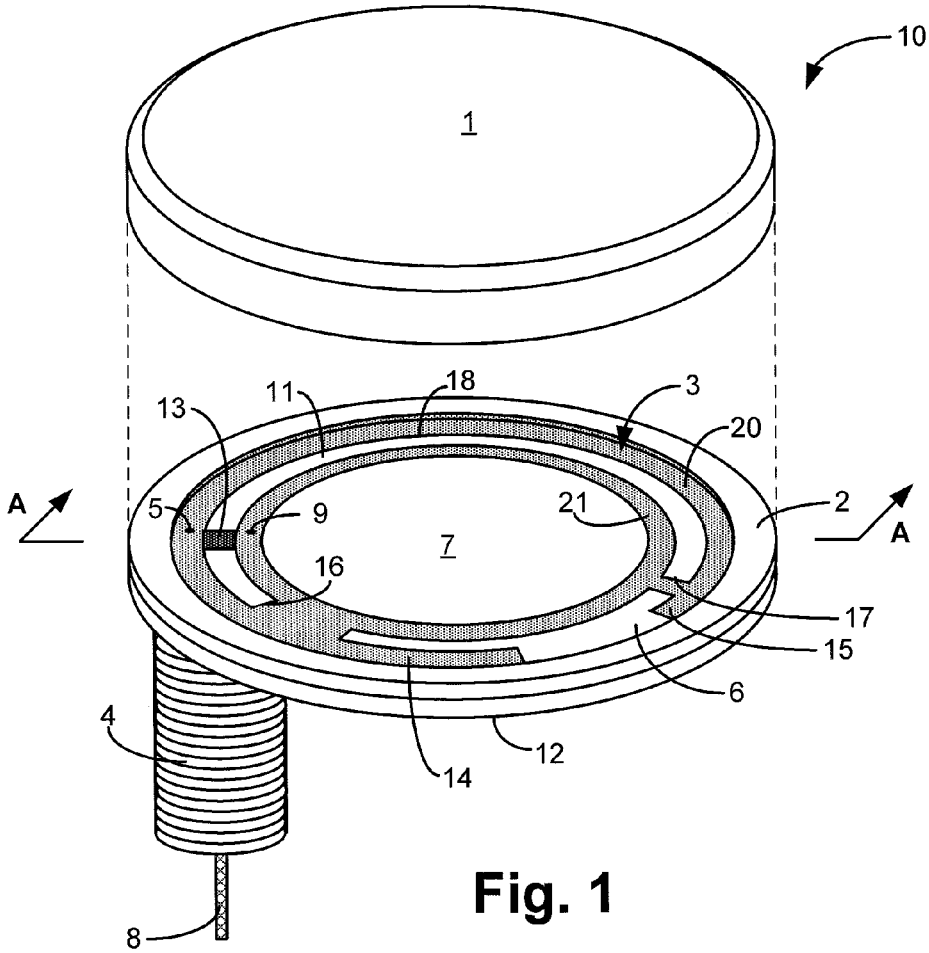
FIG. 1 is a partially-exploded side perspective view of an antenna in accordance with an embodiment of the present disclosure.

FIG. 1 is a partially exploded view of an antenna 10 in accordance with an embodiment of the present disclosure. The antenna 10 comprises a substantially disk-shaped housing 2 and a top cover 1. In one embodiment, the housing 2 and the top cover 1 are made of an insulating material, such as, for example, polypropylene, nylon and fiberglass.

During operation, the top cover 1 is affixed to the housing 2. As will be described further herein, the antenna 10 emits electromagnetic waves (not shown) that are predominantly vertically polarized, but have some horizontal radiation. Such electromagnetic waves are emitted through the top cover 1 when it is affixed to the housing 2.

The housing 2 comprises a shallow cavity 6 and a substantially circular protrusion 7 that extends from the cavity 6. The circular protrusion 7 is also made of an insulating material, such as, for example polypropylene. Notably, in one embodiment, the shallow cavity 6 is integrally formed with the circular protrusion 7.

Fixed within the cavity 6 is a radiating element 3. The radiating element 3 is substantially disk-shaped and is made of a conductive material, such as, for example copper. In one embodiment, the radiating element 3 is made from a stamped piece of metal copper alloy having a thickness of 0.5 mils.

Furthermore, the radiating element 3 comprises a slot 11 formed within the radiating element 3. The slot 11 is formed in an arc shape. Notably, the slot 11 is formed by the absence of the conductive material that makes up the radiating element 3. In one embodiment, the slot 11 exhibits a uniform width. The slot 11 is disposed between an inner peripheral portion 21 of the radiating element 3 and an outer peripheral portion 20 of the radiating element 3. In the illustrated embodiment, the radial widths of the inner peripheral portion 20, the outer peripheral portion 21, and the slot 11 are substantially similar.

The impedance of the slot 11 is distributed along the slot 11 in such a way that at a first end 16 and a second end 17 of the slot 11 the impedance is the lowest, i.e., at the very ends of the slot the impedance is substantially zero. As the slot 11 continues from the ends 16 and 17 to the middle 18 of the slot 11, the impedance increases, e.g., the impedance reaches an amount from typically about 300 to about 500 ohms (Ω).

The antenna 10 further comprises a tube 4. The tube 4 is substantially circular and hollow. The tube 4 is affixed to an underside 12 of the housing 2. The tube may be made of any type of plastic material known in the art or future-developed. The tube 4 as depicted in FIG. 1 is affixed to the housing 2 offset from a center of the housing 2. The tube 4 allows the antenna 10 to be affixed to a structure (not shown), and the tube 4 fits within an opening (not shown) in the structure.

A coaxial cable 8 extends through through the tube 4 and through an opening 13 in the circular protrusion 7. The coaxial cable 8 comprises a shield and a wire (not shown). The shield is electrically connected at point 9 to the radiating element 3 on one side of the slot 11. In addition, the wire is electrically connected at point 5 on the opposite side of the slot 11 from the point 9. The points 9 and 5 are also referred to herein as the "feed points," and are the points where voltage is applied to the radiating element. The feed points 9 and 5 are generally aligned with one another with respect to a center of the radiating element 3. The location of the feed points 9 and 5 along the slot 11 is determined by the impedance desired to be balanced, as further discussed herein.

As described hereinabove, the slot 11 exhibits its lowest impedance at its ends 16 and 17, and the impedance of the slot 11 increases from the ends 16 and 17 to a center point 18 of the slot 11. Furthermore, the coaxial cable 8 exhibits an impedance that is in the range of 50 to 75Ω in an exemplary embodiment. Thus, the coaxial cable 8 is connected to the radiating element 3 at points 9 and 5, which is that portion of the slot 11 that exhibits impedance at 50 to 75Ω.

During operation, a radio frequency (RF) signal is supplied from a signal source (not shown) to the coaxial cable 8. The RF signal is applied at points 9 and 5 on the radiating element 3. The RF signal applied produces an alternating current (AC) in the radiating element 3, which produces an electromagnetic wave (not shown) emanating from the slot 11. The electromagnetic waves emanating from the slot 11 are primarily vertically polarized, with some horizontal components. In this regard, the vertically polarized electromagnetic waves emanate from the slot, and the horizontally polarized electromagnetic waves emanate from the arced portions of the slot 11. The electromagnetic waves are radiated uniformly from the radiating element 3.

Note that the underside 12 of the housing 2 is substantially flat. This allows the antenna 10 to be mounted to a structure (not shown) with the tube 4 passing through the structure. For example, the antenna 10 may be mounted to a cover of a water meter (not shown). In this regard, the antenna 10 is a low profile antenna that allows easy installation where a conventional antenna, for example a rod antenna, would be difficult to use.

In the illustrated embodiment, the radiating element 3 comprises a first tuning stub 14 and a second tuning stub 15 extending along a an outer peripheral portion 20 of the element 3. The first tuning stub 14 tunes a low end of frequency, which corresponds to the first end 16 of the slot 11 in one embodiment. The second tuning stub 15 tunes a high end of frequency, which corresponds to the second end 17 of the slot 11 in one embodiment. In this regard, in one embodiment the radiating element spans a frequency of generally 450 megahertz (MHz) to 470 MHz. The frequency of 450 MHz corresponds to the first end 16 of the slot 11, and the frequency of 470 MHz corresponds to the second and 17 of the slot 11. The middle 18 of the slot 11 corresponds to 460 MHz. The frequency in the middle 18 of the slot 11 tends to remain stable. However, in the absence of tuning stubs 14 and 15, the frequency at the ends of the span tends to fluctuate. The tuning stubs "tune" the ends of the frequency span to enable a 20 MHz span (from 450 to 470 MHz) while holding the standing wave ratio (SWR) to below 2.5:1, which is desirable. The antenna 10 operates as a half-wave antenna when operated in this frequency range.

The antenna 10 may alternatively be used as a full-wave antenna when operating in a frequency range of 902 MHz to 928 MHz. When used at this frequency range, the frequency of 902 MHz corresponds to the second end 16 of the slot 11 and the frequency of 928 MHz corresponds to the first end 17 of the slot 11. Note that this is opposite from the 460 MHz operation, in which the first end 16 of the slot corresponded to the lower frequency. The first tuning stub 14 tunes the high end of the frequency span and the second tuning stub tunes the low end of the frequency span.

Figure 2:
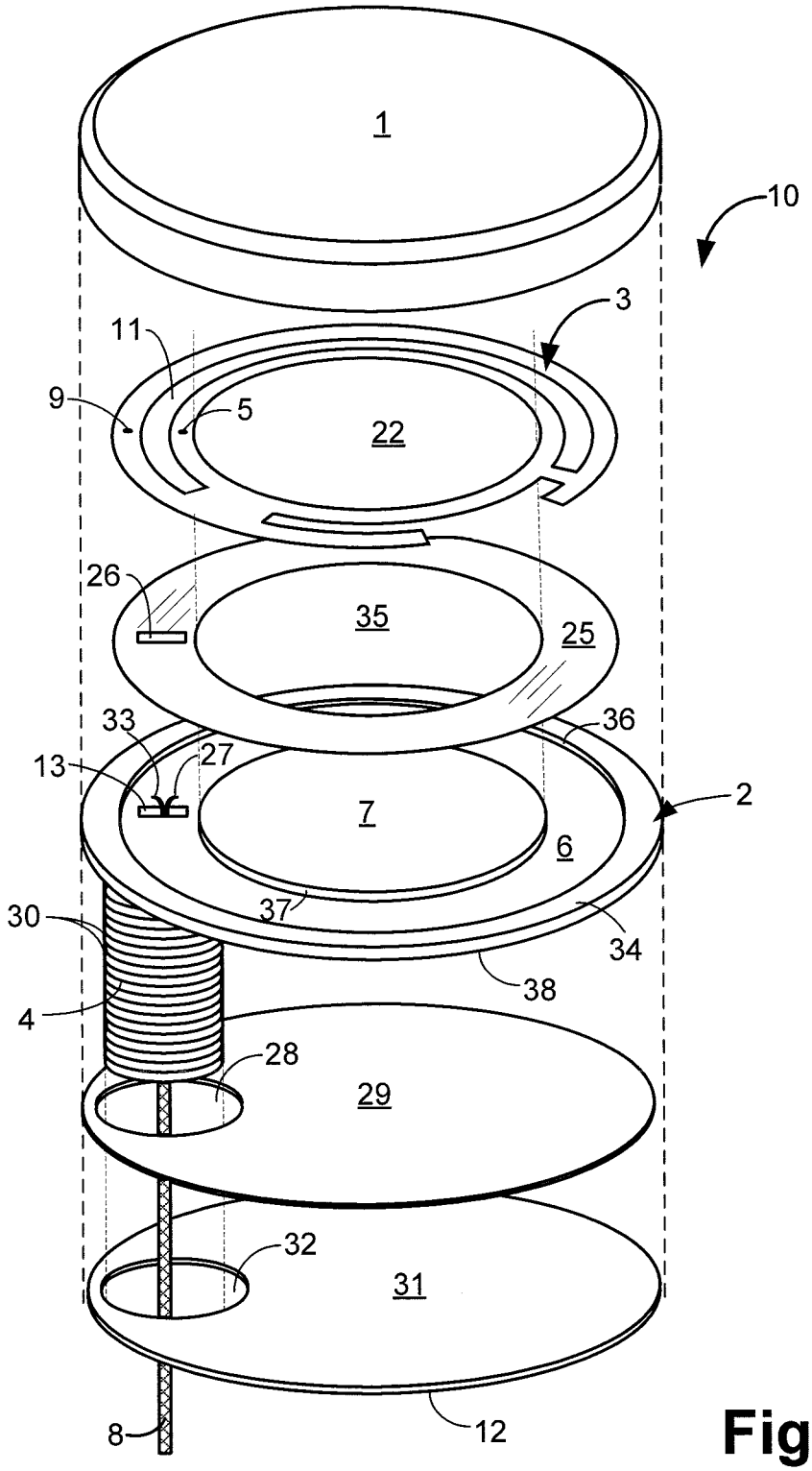
FIG. 2 is a fully-exploded side perspective view of the antenna of FIG. 1.

FIG. 2 is a fully exploded view of the antenna 10 of FIG. 1. The housing 2 comprises the opening 13 through which a shield 27 and wire 33 of the coaxial cable 8 extend. The opening 13 extends through the tube 4 and opens into the cavity 6 of the housing 2. The tube 4 comprises a plurality of male threads 30 on its exterior surface. The threads 30 may receive a nut (not shown) for attaching the antenna 10 to a water meter cover (not shown), for example.

The cavity 6 is generally disk-shaped with a smooth surface. The circular protrusion 7 extends upwardly from the cavity and comprises a circular outer wall 37. The housing 2 further comprises a peripheral rim 34 that extends upwardly from the cavity 6 and comprises a circular inner wall 36. The cavity 6 is thus bounded on its inner side by the outer wall 37 of the circular protrusion 7 and on its outer side by inner wall 36 of the peripheral rim 34.

An insulator disk 25 is received by the cavity 6. The insulator disk is a thin plastic disk with a central circular opening 35 in one embodiment. The circular protrusion extends through the central circular opening when the insulator disk 25 is installed within the cavity 6. The insulator disk 25 comprises a slot opening 26 through which the shield 27 and wire 33 extend.

The radiating element 3 is disposed on the insulator disk 25 within the cavity 6. In this regard, the radiating element 3 comprises a central opening 22 which is received by the circular protrusion 7 of the housing 2. The feed points 5 and 9 of the radiating element 3 comprise the points at which the shield 27 and wire 33 extend are attached. In this regard, the shield 27 is then soldered to the feed point 9 and the wire 33 is soldered to the feed point 9.

The cover 1 is sealedly affixed to the housing 2, enclosing the insulator disk 25 and radiating element 3 within. In this regard, one or more seals (not shown) seal the cover 1 to the housing 2 in order to keep moisture away from the radiating element 3. The seals may comprise o-ring seals or gaskets or other suitable sealing means. The cover 1 is adhered to the housing 2 with adhesive in one embodiment.

A parasitic element 29 is disposed beneath the housing 2. The parasitic element isolates the radiating element from any surface material to which the antenna 10 is mounted. In addition, the parasitic element 29 distributes any inductance or capacitive reactance effect upon the radiating element, which is described further herein.

The parasitic element 29 is a generally flat, thin circular conductive plate, formed from 0.5 mm thick metal in one embodiment. The parasitic element 29 is sandwiched between a flat bottom surface 38 of the housing 2 and a bottom cover plate 31 of the housing 12. The bottom cover plate 31 comprises a generally flat, generally thin circular plate formed from the same material as the housing 2. Both the parasitic element 29 and the bottom cover plate 31 comprise circular openings (28 and 32, respectively) for receiving the tube 4. In the illustrated embodiment, the circular openings 28 and 32 are off-center with respect to the center of the housing 2. This is because the tub 4 is similarly off-center.

The bottom cover plate 31 is sealedly affixed to the housing 2, enclosing the parasitic element 29 therebetween. In this regard, one or more seals (not shown) seal the bottom cover plate 31 to the housing 2 in order to keep moisture away from the parasitic element 29. The seals may comprise o-ring seals or gaskets or other suitable sealing means. The bottom cover plate 31 is adhered to the housing 2 with adhesive in one embodiment.

Figure 3:
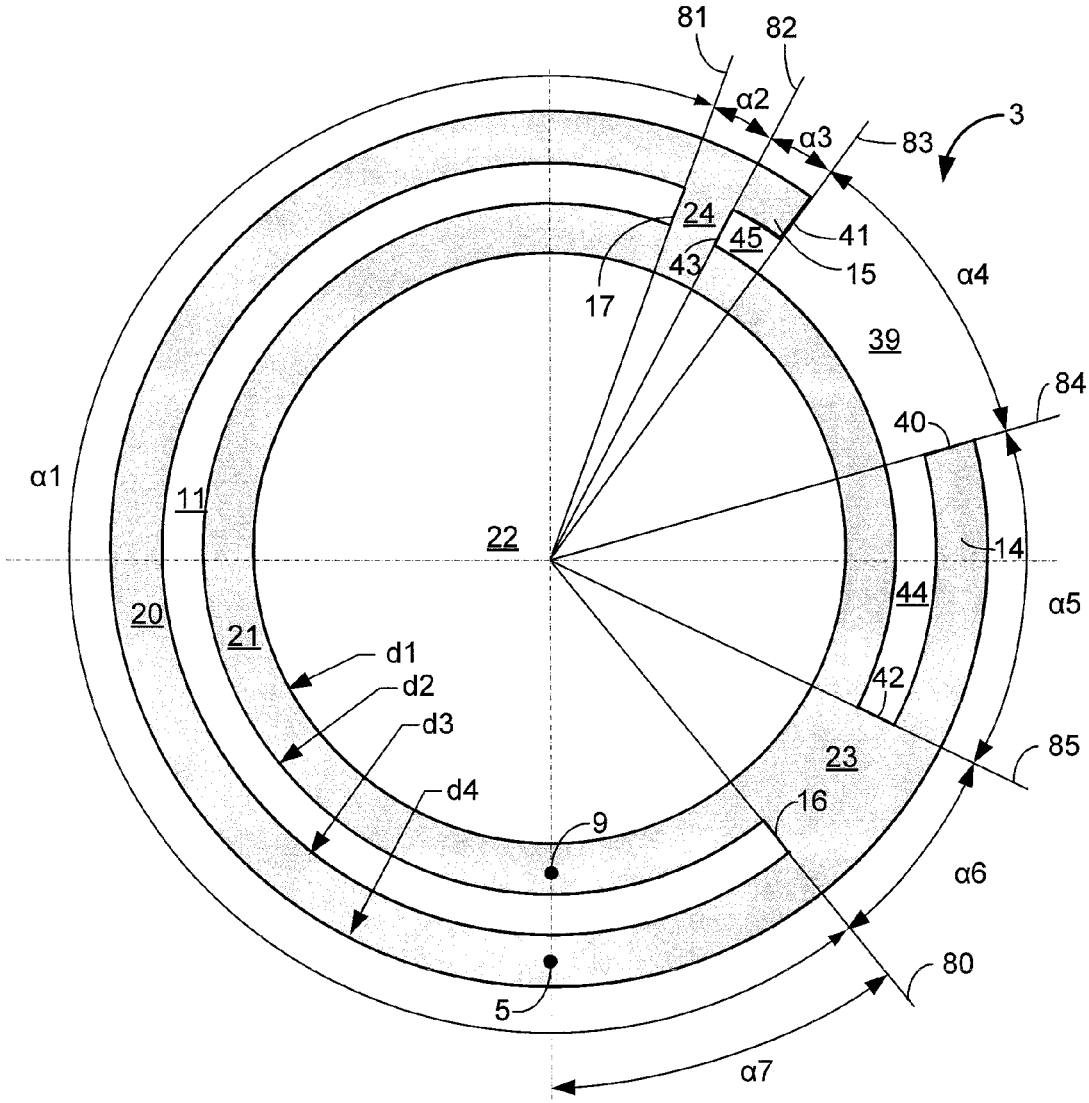
FIG. 3 is a top plan view of a typical radiating element according to an embodiment of the present disclosure.

FIG. 3 is a top plan view of the radiating element 3 of FIG. 1. The central opening 22 is substantially circular and substantially centered within the radiating element 3. The central opening 22 has a diameter "d1" with a radius of 85.1 mm in the illustrated embodiment. The inner peripheral portion 21 of the radiating element 3 is substantially circular and substantially centered within the radiating element 3. The inner peripheral portion 21 has an outer diameter "d2" which corresponds to the inner diameter of the slot 11 and which has a radius of 97.5 mm in the illustrated embodiment. The inner peripheral portion 21 is continuous and completely surrounds the center opening 22. The slot 11 is substantially semi-circular and has an outer diameter "d3" which corresponds to the inner diameter of the outer peripheral portion 20 and has a radius of 110.4 mm in the illustrated embodiment.

The outer peripheral portion 20 is substantially semi-circular and has an outer diameter "d4" which has a radius of 123.0 mm in the illustrated embodiment. The widths of the slot 11, the inner peripheral portion 21, and the outer peripheral portion 20 are each substantially uniform around the radiating element.

The slot 11 is bounded by the outer peripheral portion 20, the first end 16 of the slot 11, the inner peripheral portion 21 and the second end 17 of the slot 11. The first end 16 of the slot 11 is generally straight and generally aligned with a radius designated 80 extending from the center of the radiating element 3. The second end 17 of the slot 11 is generally straight and generally aligned with a radius designated 81 extending from the center of the radiating element 3. The circumferential length of the slot 11 (i.e., the arc length from the first end 16 to the second end 17) is substantially greater than the width of the slot 11. The circumferential length of the slot 11 varies in other embodiments, and depends on the desired frequency band.

A first bridge portion 23 extends between the inner peripheral portion 21 and the outer peripheral portion 20 adjacent to the first end 16 of the slot 11. The first bridge portion 23 is bounded in the radial direction by the first end 16 of the slot 11 and a first stub base end 42. The first bridge portion extends an angle of "α6," i.e., the angle between the first end 16 of the slot 11 and the first stub base end 42 is "α6," which is generally 25 degrees in the illustrated embodiment. The first stub base end 42 is generally aligned with a radius designated 85 extending from the center of the radiating element 3. The dimensions of the first bridge portion 23 may be different in other embodiments, depending upon the desired frequencies.

The outer peripheral portion 20 extends from the first stub base end 42 an angle "α5" to form the first tuning stub 14. In other words, the first tuning stub 14 comprises an arc-shaped extension from the outer peripheral portion 20 beyond the first end 16 of the slot. The first tuning stub 14 is in the same plane as the radiating element 3. The first tuning stub 14 forms an arc-shaped first partial slot 44, "partial" in the sense that it is bounded by the radiating element 3 on only three (3) sides. In this regard, the first partial slot 44 is bounded by the first tuning stub 14, the first stub base end 42, and the inner peripheral portion 21.

The first tuning stub 14 terminates at a first tuning stub end 40. The first tuning stub end 40 is generally straight and generally aligned with a radius designated 84 extending from the center of the radiating element 3. The angle α5 is measured between the first stub base end 42 and the first tuning stub end 40, and is generally 45 degrees in the illustrated embodiment. The angle α5 may vary in other embodiments, depending upon the desired frequencies.

A second bridge portion 24 extends between the inner peripheral portion 21 and the outer peripheral portion 20 adjacent to the second end 17 of the slot 11. The second bridge portion 24 is bounded in the radial direction by the second end 17 of the slot 11 and a second stub base end 43. The second bridge portion 24 extends an angle of "α2," i.e., the angle between the second end 17 of the slot 11 and the second stub base end 43 is "α2," which is generally 7 degrees in the illustrated embodiment, and which may vary in other embodiments. The second stub base end 43 is generally aligned with a radius designated 82 extending from the center of the radiating element 3

The outer peripheral portion 20 extends from the second stub base end 43 an angle "α3" to form the second tuning stub 15. In other words, the second tuning stub 15 comprises an arc-shaped extension from the outer peripheral portion 20 beyond the second end 17 of the slot. The second tuning stub 15 is in the same plane as the radiating element 3. The second tuning stub 15 forms an arc-shaped second partial slot 45, "partial" in the sense that it is bounded by the radiating element 3 on only three (3) sides. In this regard, the second partial slot 45 is bounded by the second tuning stub 15, the second stub base end 43, and the inner peripheral portion 21.

The second tuning stub 15 terminates at a second tuning stub end 41. The second tuning stub end 41 is generally straight and generally aligned with a radius designated 83 extending from the center of the radiating element 3. The angle α3 is measured between the second stub base end 43 and the second tuning stub end 41, and is generally 45 degrees in the illustrated embodiment. In other embodiments, the angle α3 may vary, depending upon the desired frequencies.

A gap 39 in the outer peripheral portion 20 is disposed between the first tuning stub end 40 and the second tuning stub end 41. The gap 39, i.e., the distance between the first tuning stub end 40 and the second tuning stub end 41, is designated as "α4" and is generally 34 degrees in one embodiment. In other embodiments, the angle α4 may vary, depending upon the desired frequencies.

The first and second tuning stubs 14 and 15 are generally the same width as the outer peripheral portion 20. Likewise, the widths of the first partial slot 44 and second partial slot 45 are generally the same width as the slot 11.

The feed points 5 and 9 are located in the outer peripheral portion 20 and inner peripheral portion 21, respectively, an angle of "α7" from the first end 16 of the slot 11. The angle "α7" is generally 35 degrees in the illustrated embodiment. In other embodiments, the angle α7 may vary, depending upon the impedance requirements.

The slot 11 extends an angle of "α1," i.e., the angle between the first end 16 of the slot 11 and the second end 17 of the slot 11 is "α1," which is 240 degrees in the illustrated embodiment. In other embodiments, the angle α1 may vary, depending upon the desired frequencies.

Figure 4:
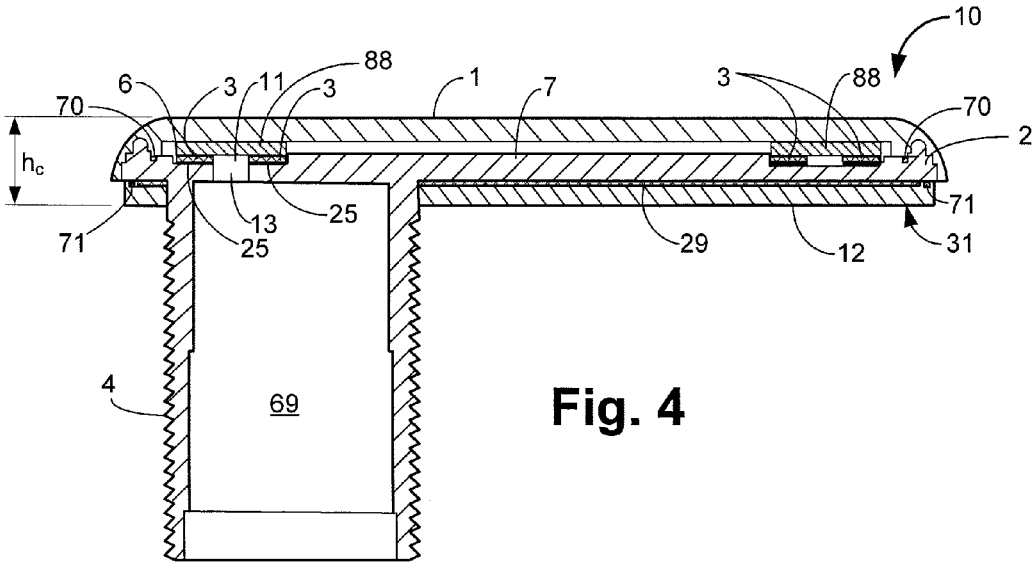
FIG. 4 is a cross-sectional view of the antenna of FIG. 1, taken along section lines "A-A" of FIG. 1.
Figure 4A:
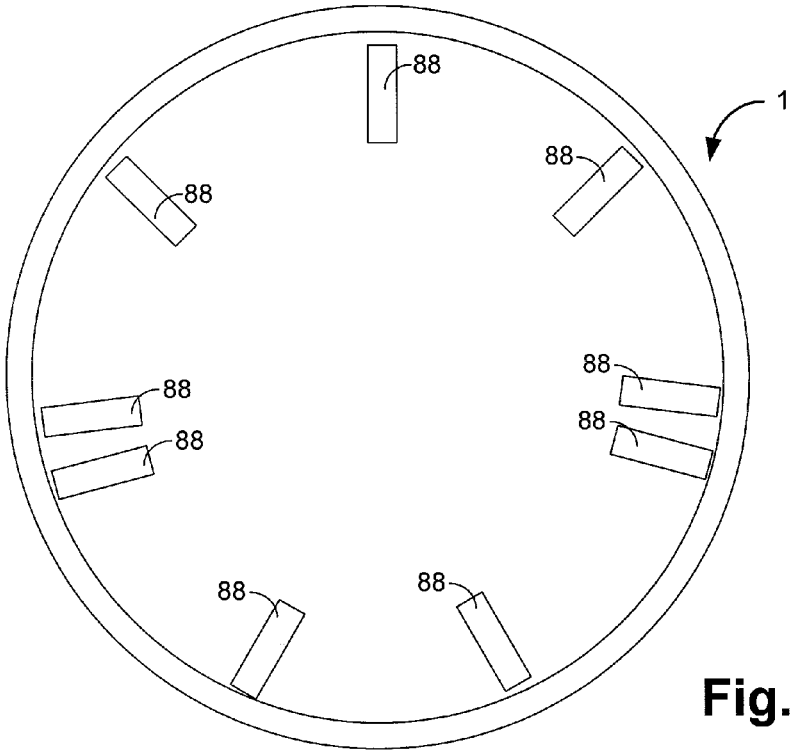
FIG. 4*a* is an inside plan view of the cover of FIG. 4.

FIG. 4 is a cross-sectional view of the antenna 10 of FIG. 1, taken along section lines "A-A" of FIG. 1, without the coaxial cable 8 of FIG. 1. The housing 2 comprises the cavity 6 which receives the insulator disk 25 and the radiating element 3. The radiating element 3 is disposed generally horizontally within the housing 2.

The tube 4 is integral with the housing 2 in this embodiment, and extends downwardly from the housing 2 and is generally vertically-disposed when installed, for example, on a meter cover. The inside 69 of the tube 4 is substantially hollow. The opening 13 extends through the housing 2 and receives the coaxial cable 8 (FIG. 1).

The parasitic element 29 is sandwiched between the underside of the housing 2 and the bottom cover plate 31. The underside 12 of the bottom cover plate 31 is substantially flat and substantially horizontally-disposed. Note that the radiating element 3 and the parasitic element 29 are both substantially flat and the housing 2 and top cover 1 are low in profile. In the illustrated embodiment, the distance between the underside 12 of the bottom cover plate 31 and a top surface of the top cover 1 (designated as "$h_c$" in FIG. 4) is generally three quarters of an inch (¾").

The outside diameter of the parasitic element 29 is larger than the outside diameter of the radiating element 3. This is desired because the parasitic element 29 shields the radiating element 3 from any surface (not shown) to which the underside 12 of the antenna 10 is mounted. Thus, the material of the surface to which the antenna 10 is mounted will not affect the performance of the antenna. Notably, the surface will not affect the resonant frequency of the radiating element 3.

A plurality of spacers 88 are disposed between the cover 1 and the radiating element 3. In the illustrated embodiment, the spacers 88 are adhered to an inside surface of the cover 1 via an adhesive. The spacers 88 are generally rectangular in shape and are formed from semi-resilient silicon in one embodiment, but may be formed from other dielectric materials in other embodiments. The spacers 88 contact the radiating element 3 and hold it place.

An o-ring type seal 70 provides a water-resistant seal between the top cover 1 and the housing 2 in this embodiment. Other sealing means, such as welding, may be employed in other embodiments. An o-ring type seal 71 also provides a water-resistant seal between the housing 2 and the bottom cover plate 31. Other sealing means may be employed in other embodiments.

FIG. 4 is an inside view of the cover 1 of FIG. 3, showing a plurality of spacers 88. The spacers 88 are disposed radially such that each spacer 88 contacts the radiating element at a different location along the circumference of the radiating element. In the illustrated embodiment, nine (9) spacers 88 are shown. Other embodiments may use more or fewer spacers.

Figure 5:
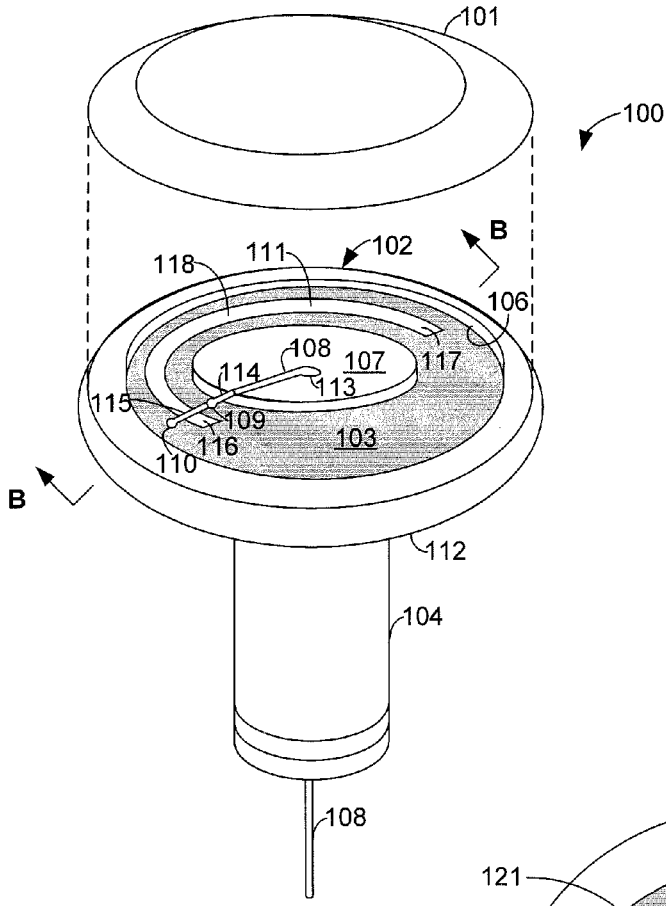
FIG. 5 is a partially-exploded side perspective view of an antenna in accordance with an embodiment of the present disclosure.

FIG. 5 is a partially exploded view of an antenna 100 in accordance with an alternative embodiment of the present disclosure. The antenna 100 comprises a housing 102 and a top cover 101. In one embodiment, the housing 102 and the top cover 101 are made of an insulating material, such as, for example polypropylene.

During operation, the top cover 101 is affixed to the housing 102. As will be described further herein, the antenna 100 emits electromagnetic waves (not shown) that are primarily vertically polarized, with some horizontal radiation. Such electromagnetic waves are emitted through the top cover 101 when it is affixed to the housing 102.

The housing 102 comprises a shallow cavity 106 and a substantially circular protrusion 107 that extends from the cavity 106. The circular protrusion 107 is also made of an insulating material, such as, for example polypropylene. Notably, in one embodiment, the shallow cavity 106 is integrally formed with the circular protrusion 107.

Fixed within the cavity 106 is a radiating element 103. The radiating element 103 is substantially circular and is made of a conductive material, such as, for example copper. In one embodiment, the radiating element 103 is made from a stamped piece of metal copper alloy having a thickness of 0.5 mils.

Furthermore, the radiating element 103 comprises a slot 111 formed within the radiating element 103. The slot 111 is formed in an arc shape. Notably, the slot 111 is formed by the absence of the conductive material that makes up the radiating element 103. In one embodiment, the slot 111 exhibits a uniform width.

The impedance of the slot 111 is distributed along the slot 111 in such a way that at the ends 116 and 117 of the slot 111 the impedance is the lowest, i.e., at the very ends it is zero. As the slot 111 continues from the ends 116 and 117 to the middle 118 of the slot 111, the impedance increases, e.g., the impedance reaches an amount from 300 to 500 ohms (Ω).

The antenna 100 further comprises a tube 104. The tube 104 is substantially circular and hollow. The tube 104 is affixed to the underside of the housing 102. The tube may be made of any type of plastic material known in the art or future-developed. The tube 104 as depicted in FIG. 1 is affixed to a center of the housing 102. The tube 104 allows the antenna 100 to be affixed to a structure (not shown), and the tube 104 fits within an opening (not shown) in the structure.

A coaxial cable 108 is fed up through the tube 104 and through an opening 113 in the circular protrusion 107. The coaxial cable 108 comprises a shield 114 and a wire 115. The shield 114 is electrically connected at point 109 to the radiating element 103 on one side of the slot 111. In addition, the wire 115 is electrically connected at point 110 on the opposite side of the slot 111 from the point 109. The wire 115 is unshielded from the connection point 109 to the connection point 110. In one embodiment, the shield 114 and the wire 115 are electrically connected to points 109 and 110, respectively, by soldering the shield 114 and the wire 115 to the radiating element 103. The points 109 and 110 are referred to herein as "feed points."

As described hereinabove, the slot 111 exhibits its lowest impedance at its ends 116 and 117, and the impedance of the slot 111 increases from the ends 116 and 117 to a center point 118 of the slot 111. Furthermore, the coaxial cable 108 exhibits an impedance that is in the range of 50 to 75Ω in an exemplary embodiment. Thus, the shield 114 and the wire 115 are connected to the radiating element 103 at feed points 109 and 110, which is that portion of the slot 111 that exhibits impedance at 50 to 75Ω.

During operation, a radio frequency (RF) signal is supplied from a signal source (not shown) to the coaxial cable 108. The RF signal is applied at points 109 and 110 on the radiating element 103. The RF signal applied produces an alternating current (AC) in the radiating element 103, which produces an electromagnetic wave (not shown) emanating from the slot 111. The electromagnetic waves emanating from the slot 111 are primarily vertically polarized, with some horizontal radiation. The electromagnetic waves are radiated uniformly from the radiating element 103.

Note that an underside 112 of the housing 102 is substantially flat. This allows the antenna 100 to be mounted to a structure (not shown) with the tube 104 passing through the structure. For example, the antenna 100 may be mounted to a water meter (not shown). In this regard, the antenna 100 is a low profile antenna that allows easy installation where a conventional antenna, for example a rod antenna, would be difficult to use.

Figure 6:
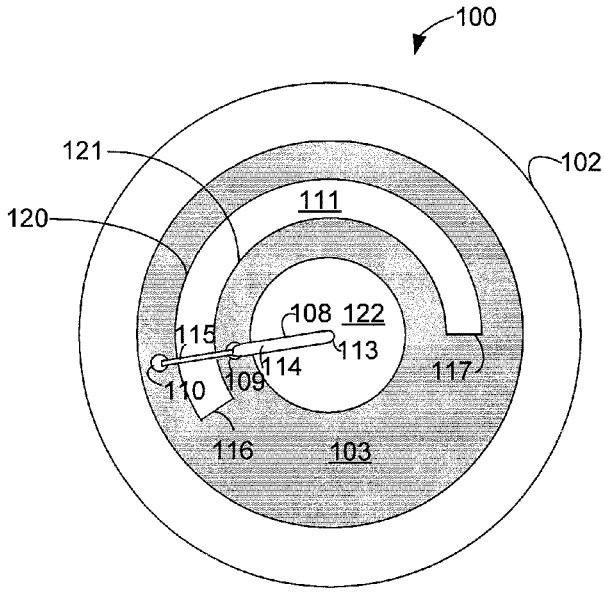
FIG. 6 is a top plan view of the antenna of FIG. 5.

FIG. 6 is a top plan view of the antenna 100 of FIG. 5, with the top cover 101 removed. The radiating element 103 comprises a central opening 122 which is generally circular. The central opening 122 is received by the protrusion 107 (FIG. 5) of the housing 102.

The slot 111 extends from the first end 116 to the second end 117. The slot 111 is bounded on its curved edges by an outer peripheral portion 120 and an inner peripheral portion 121.

Figure 7:
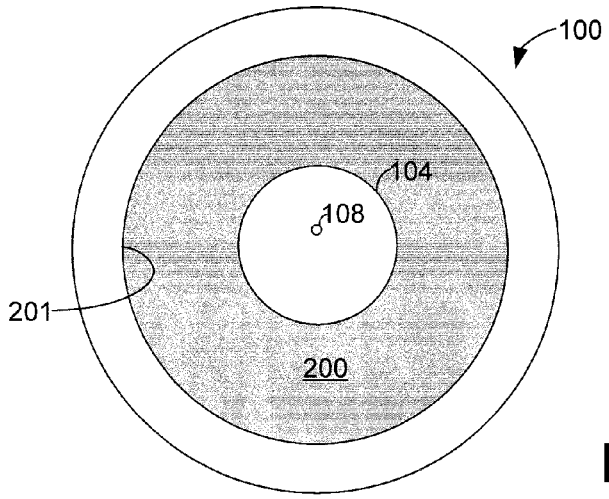
FIG. 7 is a bottom plan view of the antenna of FIG. 5.

FIG. 7 depicts a bottom plan view of the housing 102 of FIG. 5. Formed within the housing 102 is a cavity 201. Within the cavity 201 is a substantially circular parasitic element 200. The parasitic element 200 can be made of any type of conductive material, such as, for example copper. The parasitic element 200 does not connect to the coaxial cable 108 or the radiating element 103 (FIG. 5).

Furthermore, the tube 104 is located in the center of the parasitic element, and the coaxial cable 108 runs up through the tube 104. In one embodiment, the diameter of the parasitic element is 76.2 mm. In addition, the diameter of the tube 104 is 43.561 mm.

The parasitic element 200 isolates the radiating element from any surface material to which the antenna 100 is mounted. In addition, the parasitic element 200 distributes inductance or capacitive reactance effect upon the radiating element, which is described further herein. A bottom cover (not shown) may cover the parasitic element 200 and adhere to the housing 102 (FIG. 5).

Figure 8:
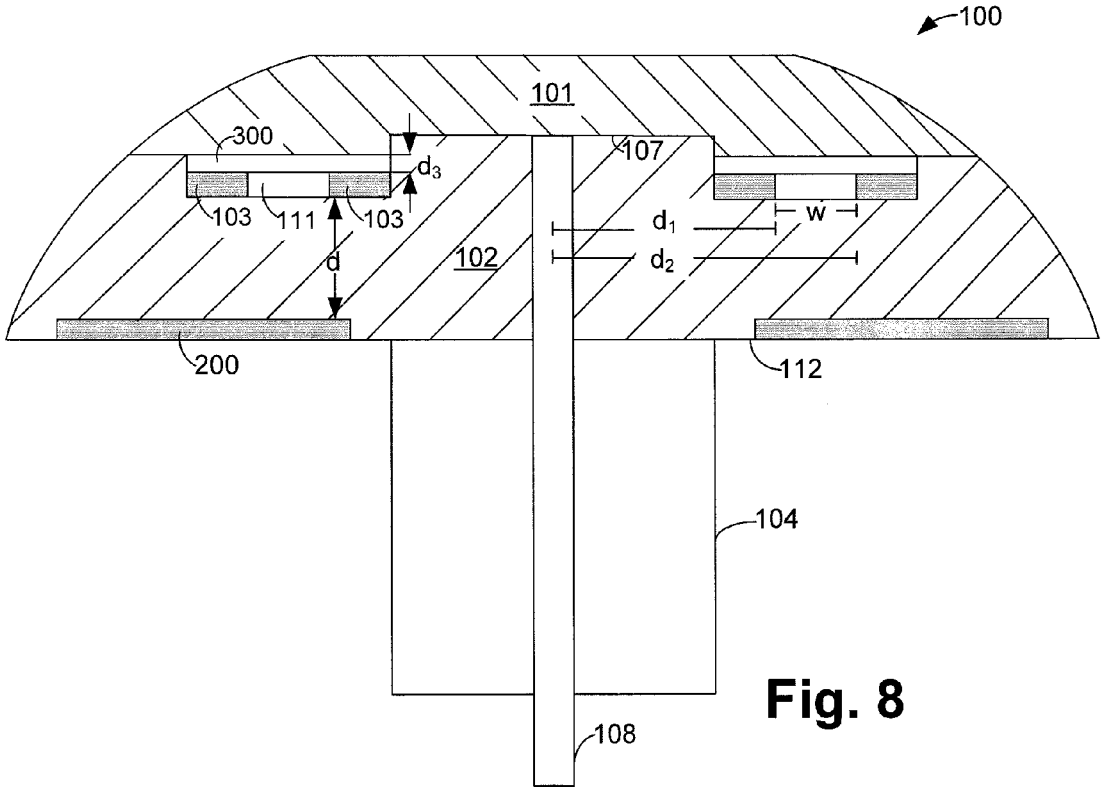
FIG. 8 is a cross-sectional view of the antenna of FIG. 5, taken along section lines "B-B" of FIG. 5.

FIG. 8 depicts a cross-sectional view of the antenna 100 depicted in FIG. 5 taken along section B-B of FIG. 5 when the top cover 101 is affixed to the housing 102. The radiating element 103 is on both sides of the slot 111.

Furthermore the parasitic element 200 is located a distance d from the radiating element 103. In one exemplary embodiment, the distance d is 9.780 mm+/−0.005 mm. The distance d is a value that is determined based upon the resonant frequency of the radiating element 103. In this regard, the radiating element 103 and the parasitic element 200 placed at a distance d from one another creates a capacitive and inductive effect. Notably, stray capacitance exists as a result of the radiating element 103 being placed in proximity with the parasitic element 200 through the insulating material of the housing 102. Such stray capacitance can add to the capacitance inherent in the radiating element 103, which is described further herein. Inductance is also inherent in the radiating element 103 and the parasitic element 200.

Furthermore, as indicated hereinabove, the parasitic element 200 shields the radiating element 103 from any surface to which the underside 112 of the antenna 100 is mounted. Thus, the material of the surface (not shown) to which the antenna 100 is mounted will not affect the performance of the antenna. Notably, the surface will have a minimal impact on the resonant frequency of the radiating element 103.

Furthermore, the parasitic element 200 and its reactance capacitive and inductive effect upon the radiating element 103 are taken into account when the dimensions of the radiating element 103 are configured. Notably, the larger the radiating element 103, the greater the inductance and capacitance of the radiating element 103. In addition, the smaller the distance d, the greater the capacitive effect on the radiating element 103. Thus, the parasitic element 200 is located within the housing 102 so as to minimize the capacitive effect of the parasitic element 200 on the radiating element 103.

Additionally, when the top cover 101 is placed upon the housing 102 as shown in FIG. 8, a small air space 300 is formed between the radiating element 103 and the top cover 101 and is a depth $d_3$. The element 103 is retained in place by a plurality of standoffs (not shown). The standoffs comprise silicon spacers in one embodiment.

Notably, the material out of which the top cover 101 is made can affect the resonant frequency characteristics of the radiating element 103. Thus, the air space 300 ensures that the top cover 101 does not affect the electromagnetic waves (not shown) that are emitted from the radiating element 103. In one exemplary embodiment, the depth $d_3$ of the air space 300 is approximately 1.55 mm+/−0.05 mm.

The dimensions of the radiating element 103 are described wherein the radiating element 103 is tuned at 915 Mega Hertz (MHz) or in the range of 902 to 928 MHz. In particular, the slot 111 has a width w of approximately 6.35 millimeters (mm)+/−0.05 mm. The inside of the slot 111 is a distance $d_1$ of approximately 25.725 mm+/−0.005 mm from the center of the protrusion 107, and the outside of the slot 111 is a distance $d_2$ of approximately 32.0675 mm+/−0.0005 from the center of the protrusion 107.

Figure 9:
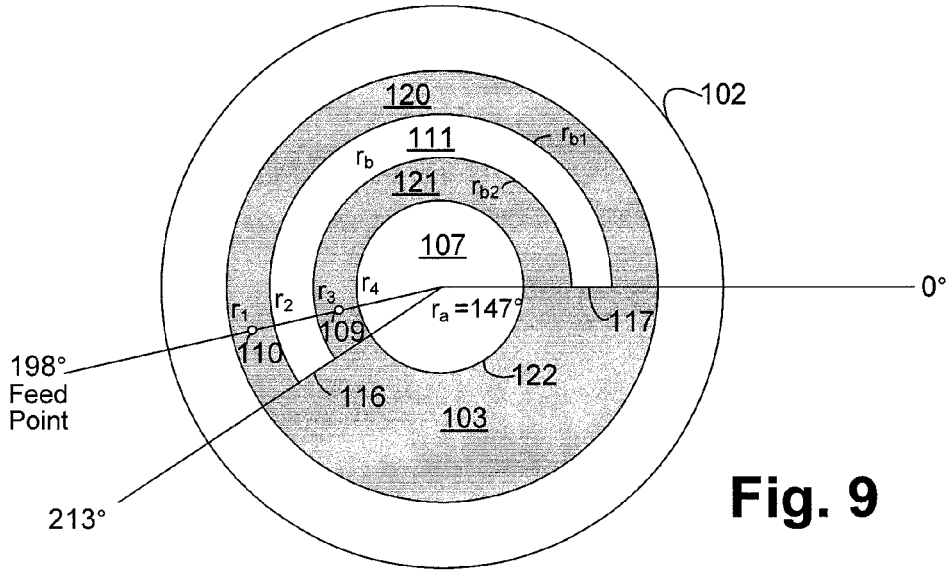
FIG. 9 is a top plan view of a radiating element of FIG. 5 that emits electromagnetic waves at a frequency of approximately 902 to 928 Mega Hertz (MHz).

With reference to FIG. 9, the slot 111 begins at 0° (measured at second end 117) and continues around to 213° (measured at first end 116) in this embodiment. The points 109 and 110 at which the coaxial shield 114 (FIG. 5) and wire 115 (FIG. 5) are placed is referred to as the "feed point" and are located at approximately 198° in the exemplary embodiment.

The designation $r_1$ represents the radius from the center point of the radiating element 103 to the outer periphery of the outer peripheral portion 120 of the radiating element 103 and is approximately 38.4175 mm+/−0.0005 mm in this embodiment. The designation r2 represents the radius from the center point of the radiating element 103 to the outside of the slot 111 and is approximately 32.0675 mm+/−0.0005 mm. The designation r3 represents the radius from the center point of the radiating element 103 to the inside of the slot 111 and is approximately 25.7175 mm+/−0.0005 mm. The designation r4 represents the radius of the central opening 122 of the radiating element 103 and is approximately 19.3675 mm+/−0.0005 mm. Notably, the shield 114 (FIG. 5) of the coaxial cable 108 (FIG. 5) is connected between $r_4$ and $r_3$, and the wire 115 (FIG. 5) of the coaxial cable 108 is connected between $r_1$ and $r_2$ at 198°.

Additionally, $r_{b1}$ is the outside radial arc length of the slot 111, and $r_{b2}$ is the inside radial arc length of the slot 111. The radial arc lengths $r_{b1}$ and $r_{b2}$ are different, i.e., $r_{b1}$ is greater than $r_{b2}$. Because of such difference, the useable bandwidth is increased above a "typical" slot antenna. This is because the half-wavelength of the inside arc $r_{b2}$ is resonant at a lower frequency and the outside arc $r_{b1}$ is resonant at a higher frequency. Thus, the combination of the lower resonant frequency and the higher resonant frequency increases the bandwidth of the antenna 100 over a rectangular shaped slot. In one embodiment, $r_{b1}$ is 32.07 mm+/−0.05 mm, and $r_{b2}$ is 25.72 mm+/−0.05 mm.

Such configuration of the radiating element 103 most efficiently radiates electromagnetic waves at a frequency between 902 and 928 MHz. Behavior of the radiating element is described further with reference to FIGS. 10 and 11.

Figure 10:
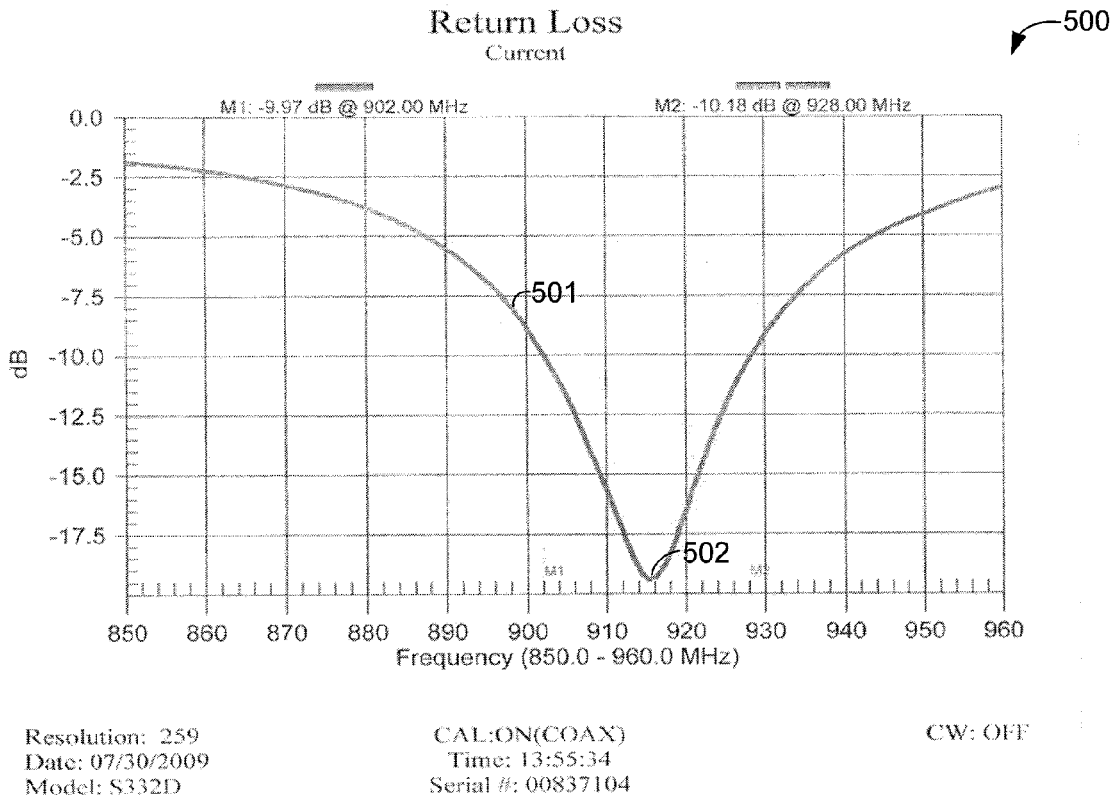
FIG. 10 is a graph depicting the resonant frequency of the radiating element depicted in FIG. 5.

FIG. 10 is a graph 500 having a graph line 501 illustrating the behavior of the radiating element 103 depicted in FIG. 9. Notably, the graph line 501 depicts how well the radiating element 103 accepts energy. In this regard, point 502 on the graph line 501 is the radiating element's resonant frequency, i.e., at point 502 is where the maximum electromagnetic radiation occurs. As the frequency approaches point 502, the radiating element 103 becomes most efficient at point 502.

Figure 11:
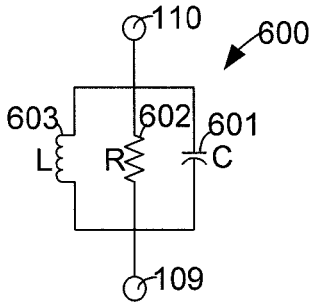
FIG. 11 is a circuit diagram depicting the radiating element of FIG. 5.

FIG. 11 depicts an RLC circuit 600 representative of the radiating element 103. An RLC circuit is one comprising a resistor 602 having a value of R ohms (Ω), an inductor 603 having a value of L henries (mH), and a capacitor 601 having a value of C farads (pF). Hence, the term RLC circuit. The RLC circuit 600 is an tuned circuit that produces electromagnetic waves having a resonant frequency determined by the following formula:

$$f = \frac{.159}{2\pi\sqrt{LC}}$$

where L is the value of the inductor, C is the value of the capacitor, and f has the units hertz (or cycles per second).

In order for resonance to occur in the RLC circuit 600 certain values are needed for the inductor 603 and the capacitor 601. In this regard, resonance of the circuit 600 occurs where $$X_L = X_C$$

Where $X_L$ is the reactance of the inductor 603 and $X_C$ is the reactance of the capacitor 601. Furthermore, $X_L$ can be determined by the following formula:

$$X_L = 2\pi fL$$

and $X_C$ can be determined by the following formula:

$$X_C = \tfrac{1}{2}\pi fC.$$

Notably, as the frequency tends to increase, the reactance of the inductor 603 increases. Further, as the frequency increases, the reactance of the capacitor 601 decreases. Thus, the reactance of the inductor 603 and the capacitor 601 are balanced to ensure that the radiating element 103 (FIG. 5) emits at a particular resonant frequency.

Figure 12:
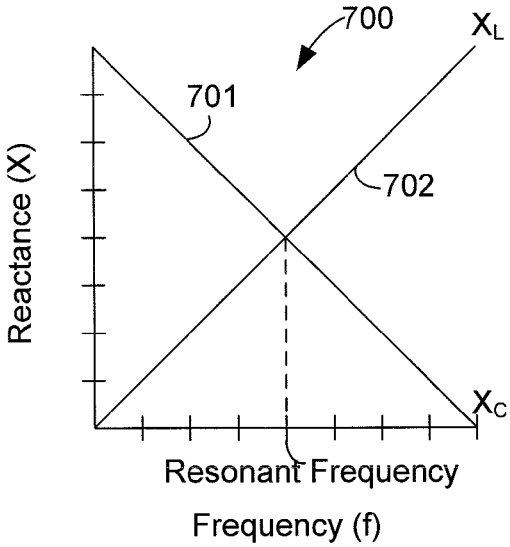
FIG. 12 is a graph depicting the resonant frequency of the circuit of FIG. 1.

FIG. 12 depicts a graph 700 that illustrates the relationship of $X_L$, $X_C$ and f. Notably, the line 702 illustrates that as the frequency increases, the reactance of the inductor 603 (FIG. 11) increases. Furthermore, the line 701 illustrates that as the frequency increases, the reactance of the capacitor 601 (FIG. 11) decreases. The point at which the lines 701 and 702 cross is that point at which the sum of the reactance is equal, i.e., the point at which the RLC circuit 600 (FIG. 11) is at its resonant frequency.

Figure 13:
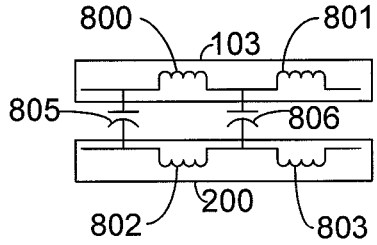
FIG. 13 is a circuit diagram depicting a radiating element and a parasitic element of FIG. 5.

FIG. 13 is a circuit diagram illustrating the effect of the parasitic element 200 (FIG. 7) on the radiating element 103 (FIG. 5). The radiating element 103 and the parasitic element 200 have inherent inductance represented by inductors 800, 801 and 802, 803, respectively. Through the insulating material of the housing 102 (FIG. 5), there is stray capacitance represented by capacitors 805, 806. Notably, the further the distance d (FIG. 8) between the radiating element 103 and the parasitic element 200, the less stray capacitance exists. However, the closer the radiating element 103 and the parasitic element 200, the more stray capacitance exists. Thus, when tuning the radiating element 103 to a particular frequency, such stray capacitance created by the radiating element 103 and the parasitic element 200 is taken into account, i.e., it adds to the capacitance of the capacitor 601 (FIG. 11).

Figure 14:
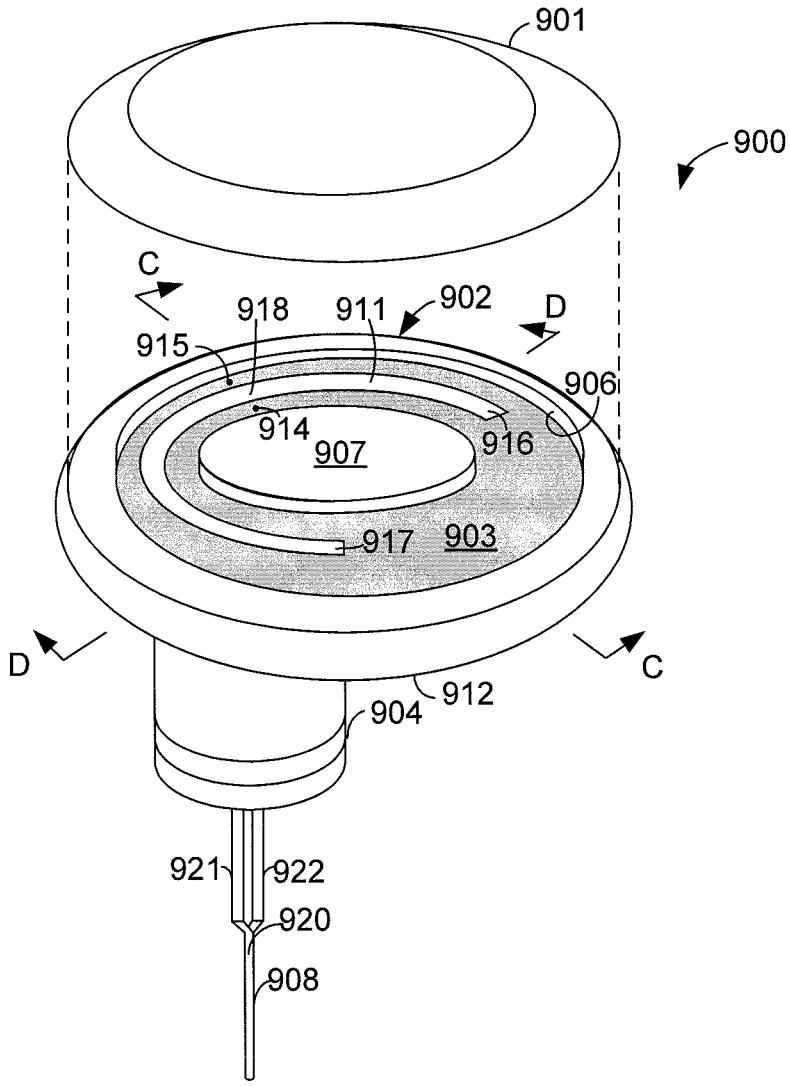
FIG. 14 is a partially exploded side perspective view of an antenna in accordance with an embodiment of the present disclosure.

FIG. 14 is an exploded view of an antenna 900 in accordance with an alternative embodiment of the present disclosure. The antenna 900 is substantially the same as the antenna 100 (FIG. 5) except for the differences described herein. In this regard, the antenna 900 comprises a housing 902 and a top cover 901. In one embodiment, the housing 902 and the top cover 901 are made of an insulating material, such as, for example polypropylene.

During operation, the top cover 901 is affixed to the housing 902. As will be described further herein, the antenna 900 emits electromagnetic waves (not shown) that are primarily vertically polarized, with some horizontal radiation. Such electromagnetic waves are emitted through the top cover 901 when it is affixed to the housing 902.

The housing 902 comprises a shallow cavity 906 and a substantially circular protrusion 907 that extends from the cavity 906. The circular protrusion 907 is also made of an insulating material, such as, for example polypropylene. Notably, in one embodiment, the shallow cavity 906 is integrally formed with the circular protrusion 907.

Fixed within the cavity 906 is a radiating element 903. The radiating element 903 is substantially circular and is made of a conductive material, such as, for example copper. In one embodiment, the radiating element 903 is made from a stamped piece of metal copper alloy having a thickness of 0.5 mils.

Furthermore, the radiating element 903 comprises a slot 911 formed within the radiating element 903. The slot 911 is formed as an arc shape. Notably, the slot 911 is formed by the absence of the conductive material that makes up the radiating element 903.

As described hereinabove, the impedance of the slot 911 is distributed along the slot 911 in such a way that at the ends 916 and 917 of the slot 911 the impedance is the lowest, i.e., at the very ends it is zero. As the slot 911 continues from the ends 116 and 117 to the middle 918 of the slot 911, the impedance increases, i.e., the impedance reaches a value of 300 to 500 ohms (Ω).

The antenna 900 further comprises a tube 904. The tube 904 is affixed to the underside of the housing 902. The tube is substantially circular and is hollow. The tube 904 may be made of any type of plastic material known in the art or future-developed. One such difference between the antenna 100 and the antenna 900 is that the tube 904 is affixed at a point off center of the housing 902. As described hereinabove, the tube 904 allows the antenna 900 to be affixed to a structure (not shown), and the tube 904 fits within an opening (not shown) in the structure.

A balun 920 is fed up through the tube 904. The balun 920 consists of a coaxial cable 908 and two traces 921 and 922. The shield (not shown) of the coaxial cable 908 is electrically connected to one of the traces 921, while the wire (not shown) of the coaxial cable 908 is electrically connected to the other trace 922. The balun 920 is a high impedance to low impedance transformer exhibiting impedance from 300 to 500Ω. Thus, the balun 920 is connected to the high impedance point 918 of the slot 911 as described further herein.

Figure 15:
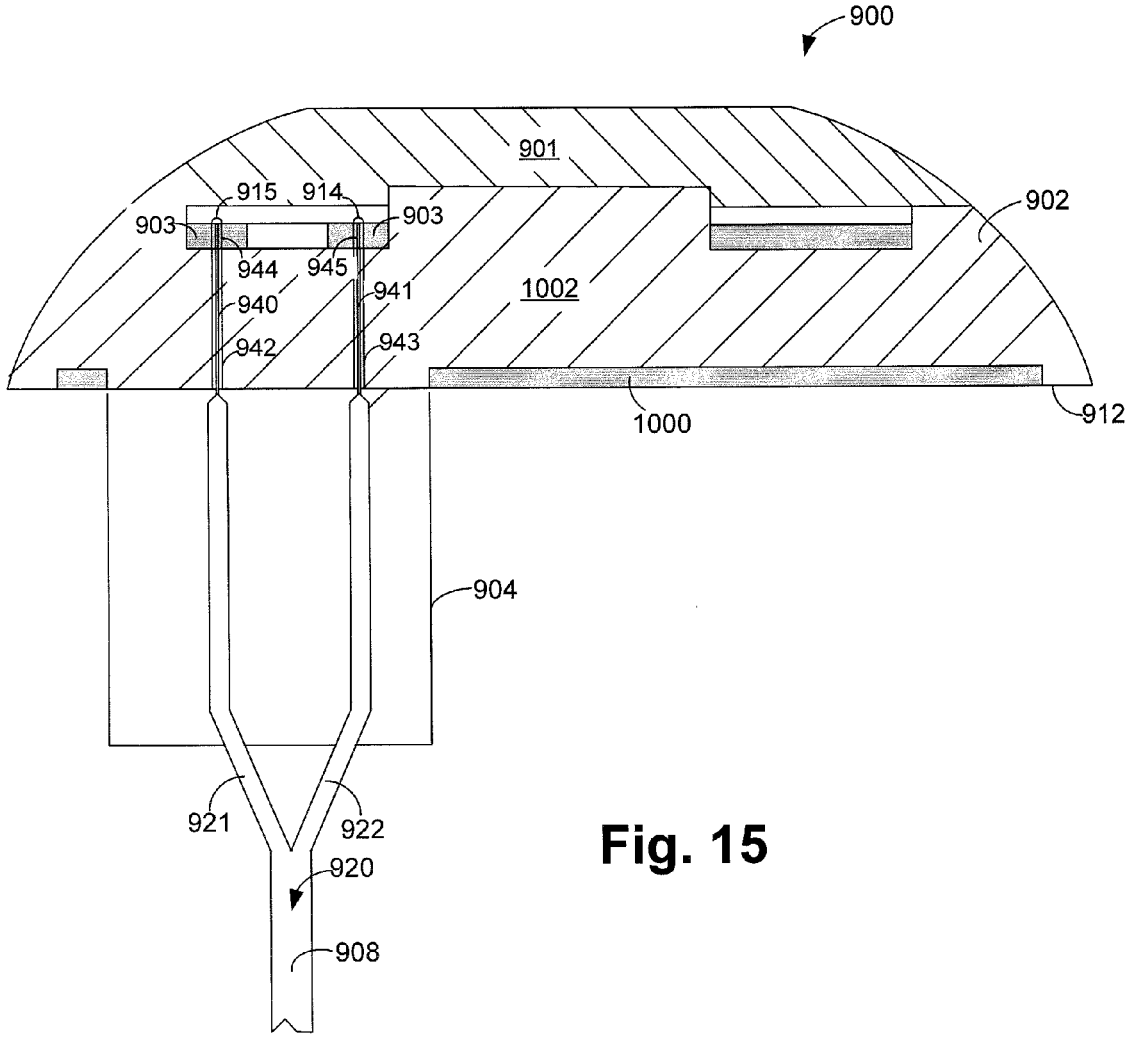
FIG. 15 is a cross-sectional view of the antenna of FIG. 14, taken along section lines "C-C" of FIG. 14.

FIG. 15 is a cross sectional view of the antenna 900 taken along section lines "C-C" of FIG. 14. With reference to FIG. 15, each of the traces 921 and 922 terminate with pins 940 and 941, respectively. The pins 940 and 941 are, for example, wires or other conductive material. Each of the traces 921 and 922 are fed through the tube 904, and the pins 940 and 941 are inserted into openings 942 and 943, respectively, in the underside 912 of the housing 902.

Additionally, the pins 940 and 941 are inserted through openings 944 and 945, respectively, in the radiating element 903. The pins 940 and 941 are soldered to the radiating element 103 at points 915 and 914, respectively.

During operation, a radio frequency (RF) signal is supplied from a signal source (not shown) to the coaxial cable 908. The RF signal is applied at points 914 and 915 on the radiating element 103. The RF signal applied produces an alternating current (AC) in the radiating element 903, which produces an electromagnetic wave (not shown) emanating from the slot 911. The electromagnetic waves emanating from the slot 911 are primarily vertically polarized, and the slot 911 is formed into an arc shape that allows for some horizontally polarized waves. The electromagnetic waves are radiated uniformly across the hemisphere.

Note that an underside 912 of the housing 902 is substantially flat. This allows the antenna 900 to be mounted to a structure (not shown). For example, the antenna 900 may be mounted to an electric meter (not shown). In this regard, the antenna 900 is a low profile antenna that allows easy installation where a conventional antenna, for example a rod antenna, would be difficult to use. A bottom cover (not shown) may be installed on the bottom surface 912 of the housing 900.

Figure 16:
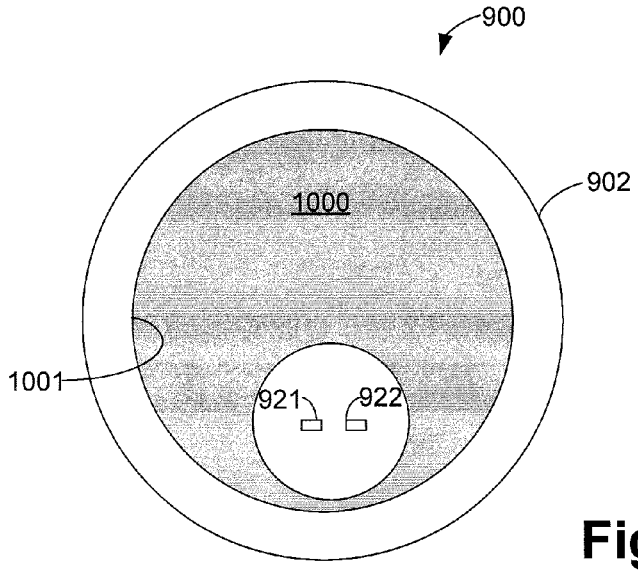
FIG. 16 depicts a bottom plan view of the antenna of FIG. 15.

FIG. 16 depicts a bottom view of the housing 902 of FIG. 14. Formed within the housing 902 is a cavity 1001. Within the cavity 1001 is a substantially circular parasitic element 1000. The parasitic element 1000 can be made of any type of conductive material, such as, for example copper. The parasitic element 1000 does not connect to the coaxial balun 920 or the radiating element 903 (FIG. 14).

Furthermore, the tube 904 is located in the off center of the parasitic element 1000, and the traces 921 and 922 extend through the tube 904. In one embodiment, the diameter of the parasitic element is 146.05 mm. In addition, the diameter of the tube 904 is 43.561 mm.

As described hereinabove, the parasitic element 1000 isolates the radiating element 903 from any surface material to which the antenna 900 is mounted. In addition, the parasitic element 1000 distributes any inductance or capacitive reactance effect upon the radiating element, which is described further herein.

Figure 17:
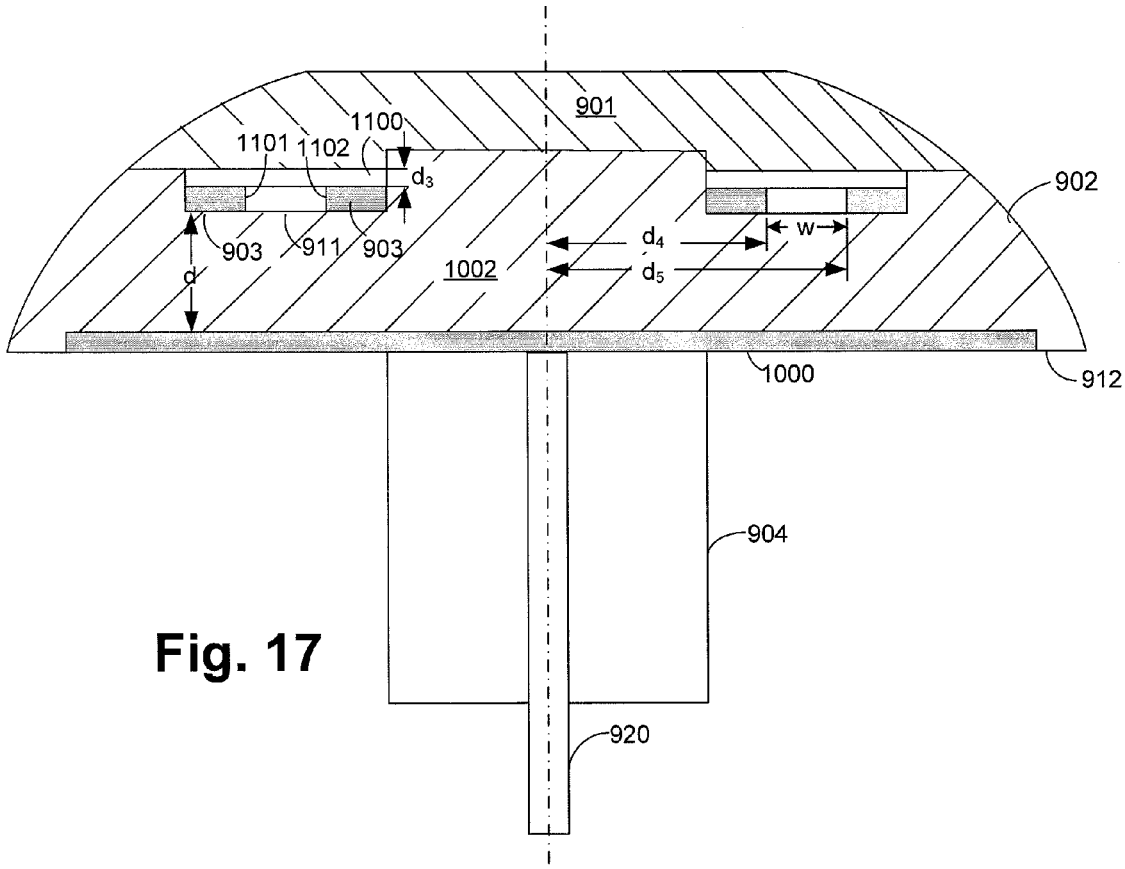
FIG. 17 is a cross-sectional view of the antenna of FIG. 14, taken along section lines "D-D" of FIG. 14.

FIG. 17 is a cross-sectional view of the antenna 900 depicted in FIG. 14 taken along section lines "D-D" of FIG. 14, when the top cover 901 is affixed to the housing 902. The radiating element 903 is on both sides 1101 and 1102 of the slot 911 as illustrated. The parasitic element 1000 is located a distance d from the radiating element 903. In one exemplary embodiment, the distance d is approximately 4.546 mm+/−0.005 mm. As described hereinabove with reference to FIG. 8, the distance d is a value that is determined based upon the resonant frequency of the radiating element 903. In this regard, the radiating element 903 and the parasitic element 1000 placed at a distance d from one another creates a capacitive effect. Notably, stray capacitance exists as a result of the radiating element 903 being placed in proximity with the parasitic element 1000 through the insulating material of the housing 902. Such stray capacitance can add to the capacitance inherent in the radiating element 903, which is described further herein.

Furthermore, as indicated hereinabove, the parasitic element 1000 shields the radiating element 903 from any surface to which the underside 912 of the antenna 900 is mounted. Thus, the material of the surface (not shown) to which the antenna 900 is mounted will minimally affect the performance of the antenna. Notably, the surface will not affect the resonant frequency of the radiating element 903.

Furthermore, the parasitic element 1000 and its reactance or capacitive and inductive effect upon the radiating element 903 is taken into account when the dimensions of the radiating element 903 are configured. Notably, the larger the radiating element 903, the greater the inductance and capacitance of the radiating element 903. In addition, the less the distance d, the greater the capacitive effect on the radiating element 903. Thus, the parasitic element 1000 is disposed within the housing 902 so as to minimize the capacitive effect of the parasitic element 1000 on the radiating element 903.

Additionally, when the top cover 901 is placed upon the housing 902 as shown in FIG. 17, a small air space 1100 is formed between the radiating element 903 and the top cover 901 and the air space 1100 has a depth $d_3$. Notably, the material out of which the top cover 901 is made can affect the resonant frequency characteristics of the radiating element 903. Thus, this air space 300 ensures that the top cover 901 does not affect the electromagnetic waves (not shown) that are emitted from the radiating element 903 by not affecting the characteristics of the radiating element 903. In one exemplary embodiment, the depth $d_3$ of the air space 1100 is approximately 1.55 mm+/−0.05 mm.

The dimensions of the radiating element 903 are described wherein the radiating element 903 is tuned at 460 Mega Hertz (MHz) or in the range of 450 to 470 MHz. In particular, the slot 911 has a width w of 6.35 mm+/−0.05 mm. The inside of the slot 911 is a distance $d_4$ of 43.545 mm+/−0.005 mm from the center of the protrusion 107, and the outside of the slot 911 is a distance $d_5$ of 48.985 mm+/−0.005 mm from the center of the protrusion 107.

Figure 18:
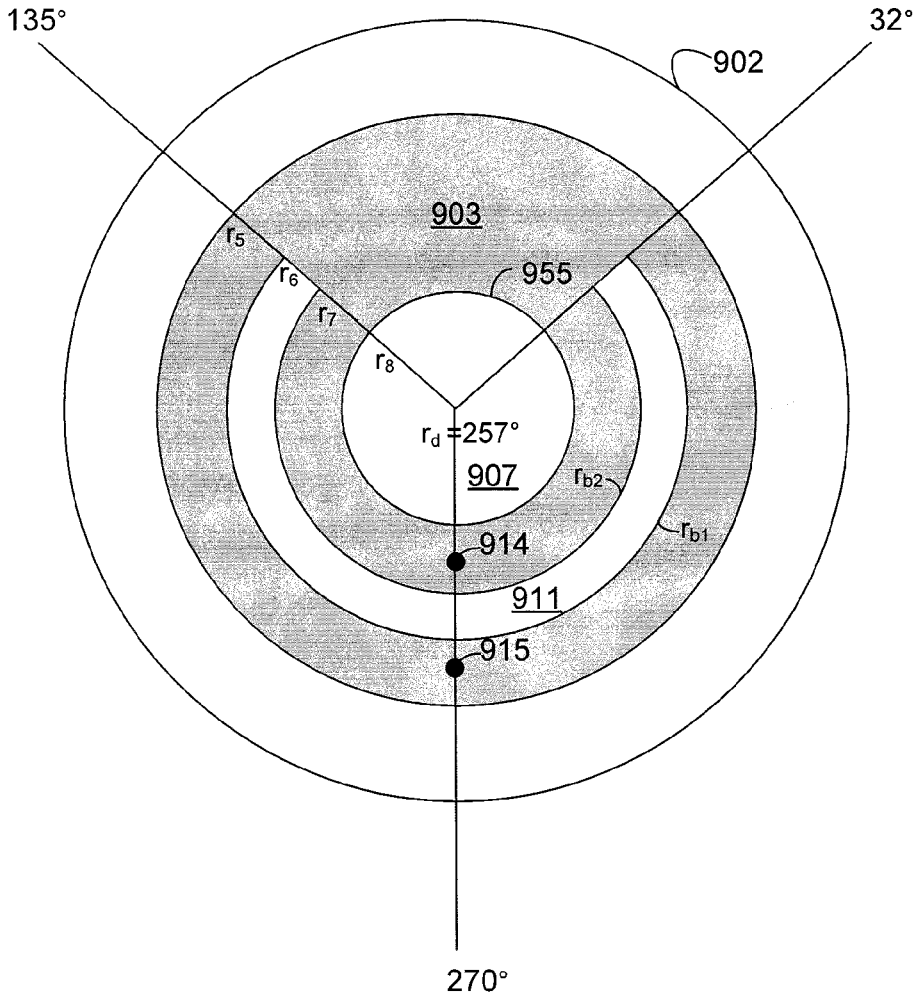
FIG. 18 is a top plan view of a radiating element of FIG. 14 that emits electromagnetic wave at a frequency of approximately 450 to 470 Mega Hertz (MHz).

With reference to FIG. 18, the slot 911 begins at 32° and continues around to 135°. Thus, the slot 911 extends approximately the angle $r_d$ for 257°. The traces 921 (FIGS. 15) and 922 (FIG. 15) are electrically connected to points 914 and 915 on the radiating element 903 at the high impedance point 918 (FIG. 14) of the slot 911, i.e., the high impedance point is at 270°. These dimensions are frequency dependant and may vary in other embodiments.

The designation $r_5$ represents the radius from the center point of the radiating element 903 to the housing 902 and is approximately 55.245 mm+/−0.005 mm. The designation $r_6$ represents the radius from the center point of the radiating element 903 to the outside of the slot 911 and is approximately 48.895 mm+/−0.005 mm. The designation $r_7$ represents the radius from the center point of the radiating element 903 to the inside of the slot 911 and is approximately 43.545 mm+/−0.005 mm. The designation $r_8$ represents the radius of the central opening 955 of the radiating element 903 and is approximately 41.91 mm+/−0.05 mm. Notably, the trace 921 is connected between $r_7$ and $r_8$ at point 914, and the trace 922 is connected between $r_5$ and $r_6$ at point 915 at approximately 270°.

Additionally, $r_{b1}$ is the outside radial arc length of the slot 911, and $r_{b2}$ is the inside radial arc length of the slot 911. The radial arc lengths $r_{b1}$ and $r_{b2}$ are different, i.e., $r_{b1}$ is greater than $r_{b2}$. Because of such difference, the useable bandwidth is increased above a normal slot antenna. This is because the half-wavelength of the inside arc $r_{b2}$ is resonant at a lower frequency and the outside arc $r_{b1}$ is resonant at a higher frequency. Thus, the combination of the lower resonant frequency and the higher resonant frequency increases the bandwidth of the antenna 100. In one embodiment, $r_{b1}$ is 48.90 mm+/−0.05 mm, and $r_{b2}$ is 48.26 mm+/−0.05 mm.

Such configuration of the radiating element 103 efficiently radiates electromagnetic waves at a frequency between 450 and 470 MHz.

Notably, the present disclosure describes antenna technology that is scalable to other frequency ranges. The present disclosure provides three examples of the antenna technology in FIGS. 1-4 (450-470 MHz), FIGS. 5-9 (902 MHz to 948 MHz) and FIGS. 14-18 (450 MHz to 470 MHz), which are working examples.

Now, therefore, the following is claimed:

1. An antenna, comprising:

a housing having a shallow cavity;

a substantially disk-shaped and substantially flat radiating element disposed in the shallow cavity, the radiating element having an arc-shape slot, the arc-shaped slot comprising a first straight end, a second straight end, an outer arc-shaped edge, and an inner arc-shaped edge the slot having a length substantially greater than a width of the slot, the radiating element further comprising a first tuning stub associated with a the first end of the a slot and a second tuning stub associated with the second end of the slot, the first and second tuning stubs each comprising extensions from the radiating element circumferentially aligned with an outer perimeter of the radiating element and in the same plane as the radiating element, the extensions forming partial slots near the first and second ends of the slot;

a substantially circular parasitic element parallel to and spaced apart from the radiating element, the parasitic element being substantially disk-shaped and substantially flat.

2. The antenna of claim 1, wherein the first end of the slot is associated with a lower frequency and the second end of the slot is associated with a higher frequency and a resonant frequency of the radiating element is in the range of 450 MHz to 470 MHz.

3. The antenna of claim 2, wherein the first tuning stub tunes the lower frequency end of the range and the second tuning stub tunes the higher frequency end of the range.

4. The antenna of claim 1, wherein the first end of the slot is associated with a higher frequency and the second end of the slot is associated with a lower frequency and a resonant frequency of the radiating element is in the range of 902 MHz to 928 MHz.

5. The antenna of claim 4, wherein the first tuning stub tunes the higher frequency end of the range and the second tuning stub tunes the lower frequency end of the range.

6. The antenna of claim 1 further comprising a tube affixed to a bottom of the housing.

7. The antenna of claim 6, the housing further comprising an opening extending through the housing and emerging into the cavity.

8. The antenna of claim 7, wherein a coaxial cable extends through the tube and through the opening.

9. The antenna of claim 8, wherein a shield of the coaxial cable is electrically connected to the radiating element on a first side of the slot.

10. The antenna of claim 9, wherein a wire of the coaxial cable is electrically connected to the radiating element on a second side of the slot.

11. The antenna of claim 8, wherein the coaxial cable is low impedance connected to the radiating element.

12. The antenna of claim 8, wherein the coaxial cable is connected to the radiating element at a point that is substantially 35 degrees from the first end of the slot.

13. The antenna of claim 12, wherein the slot extends substantially 240 degrees from the first end to the second end.

14. The antenna of claim 4, wherein the tube is affixed off center of the bottom of the housing.

15. The antenna of claim 1, wherein the radiating element further comprises a circular central opening extending through the radiating element.

16. The antenna of claim 15, wherein the radiating element further comprises a disk-shaped inner peripheral portion that completely encircles the circular central opening.

17. The antenna of claim 16, wherein the radiating element further comprises a semi-circular outer peripheral portion, wherein the outer peripheral portion and the inner peripheral portion are disposed on opposed sides of the slot.

18. The antenna of claim 16, wherein the radiating element comprises a gap circumferentially aligned with the outer peripheral portion, wherein the gap is bounded by the first and second tuning stubs.

19. The antenna of claim 1, further comprising a top cover coupled to the housing to sealedly retain the radiating element within the housing.

20. An antenna, comprising:

a substantially flat, disc-shaped radiating element having an arc-shaped slot formed therein, the radiating element comprising a first tuning stub associated with a first end of the slot and a second tuning stub associated with a second end of the slot, the radiating element, the slot, the first tuning stub, and the second tuning stub all lying in substantially the same plane;

a substantially flat, disk-shaped parasitic element substantially parallel to the radiating element and separated from the radiating element by a dielectric material; and a cable electrically connected to the radiating element.

21. The antenna of claim 20, wherein the cable is a coaxial cable and is connected to the radiating element across the slot such that a shield of the coaxial cable is electrically connected to a first side of the slot and a wire of the coaxial cable is electrically connected to a second side of the slot.

22. The antenna of claim 20, wherein the radiating element comprises a central opening that extends through the radiating element, an inner peripheral portion that surrounds the central opening, and a semi-circular outer peripheral portion, the inner peripheral portion and the outer peripheral portion disposed on opposed sides of the slot.

* * * * *